US008753417B1

(12) United States Patent
DellaCorte et al.

(10) Patent No.: US 8,753,417 B1
(45) Date of Patent: Jun. 17, 2014

(54) HIGH TEMPERATURE SOLID LUBRICANT COATING FOR HIGH TEMPERATURE WEAR APPLICATIONS

(75) Inventors: Christopher DellaCorte, Cleveland, OH (US); Brian J Edmonds, Cleveland, OH (US)

(73) Assignee: The United States of America as Represented by the Administrator of National Aeronautics and Space Administration, Washington, DC (US)

( * ) Notice: Subject to any disclaimer, the term of this patent is extended or adjusted under 35 U.S.C. 154(b) by 330 days.

(21) Appl. No.: 12/726,926

(22) Filed: Mar. 18, 2010

(51) Int. Cl.
*C22C 32/00* (2006.01)

(52) U.S. Cl.
USPC ..... 75/231; 75/232

(58) Field of Classification Search
USPC ..... 75/232, 252
See application file for complete search history.

(56) References Cited

U.S. PATENT DOCUMENTS

| | | | | |
|---|---|---|---|---|
| 4,728,448 | A * | 3/1988 | Sliney | 508/104 |
| 5,866,518 | A * | 2/1999 | Dellacorte et al. | 508/104 |
| 6,254,660 | B1 * | 7/2001 | Bernard et al. | 75/252 |
| 7,615,291 | B2 * | 11/2009 | Lee et al. | 428/701 |

OTHER PUBLICATIONS

Stanford, Malcolm K., Yanke, Anne M., Dellacorte, Christopher, Thermal Effects on a Low Cr Modification of PS304 Solid Lubricant Coating, NASA/TM-2004-213111, Jun. 2004.

* cited by examiner

*Primary Examiner* — George Wyszomierski
*Assistant Examiner* — Ngoclan T Mai
(74) *Attorney, Agent, or Firm* — Robert H. Earp, III

(57) ABSTRACT

A self-lubricating, friction and wear reducing composite useful over a wide temperature range is described herein. The composite includes metal bonded chromium oxide dispersed in a metal binder having a substantial amount of nickel. The composite contains a fluoride of at least one Group I, Group II, or rare earth metal, and optionally a low temperature lubricant metal.

12 Claims, 5 Drawing Sheets

Figure 2 A
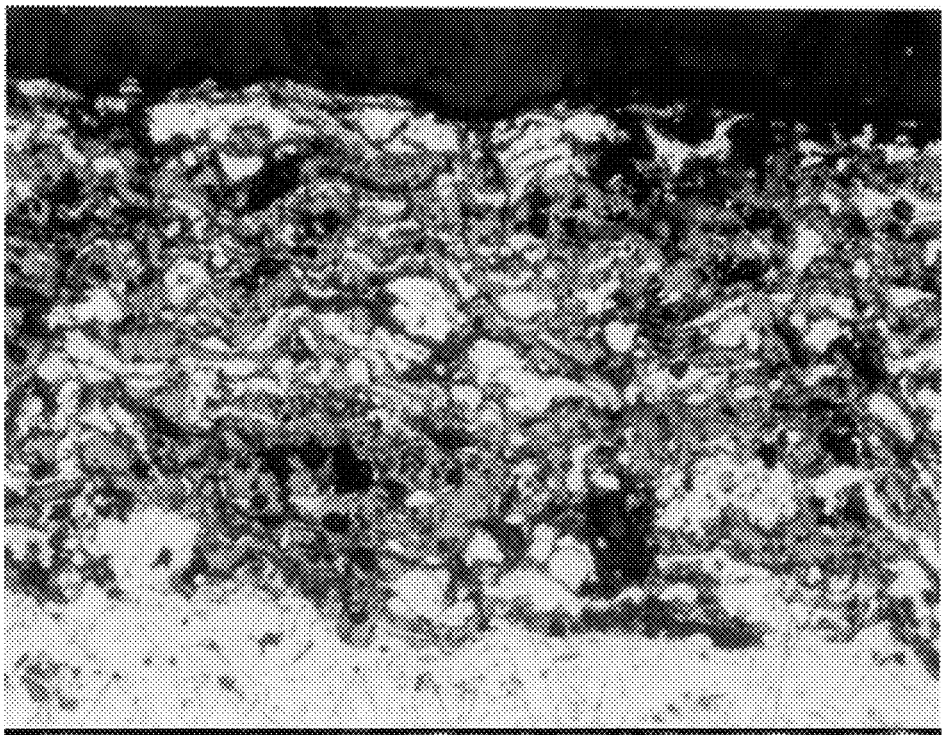
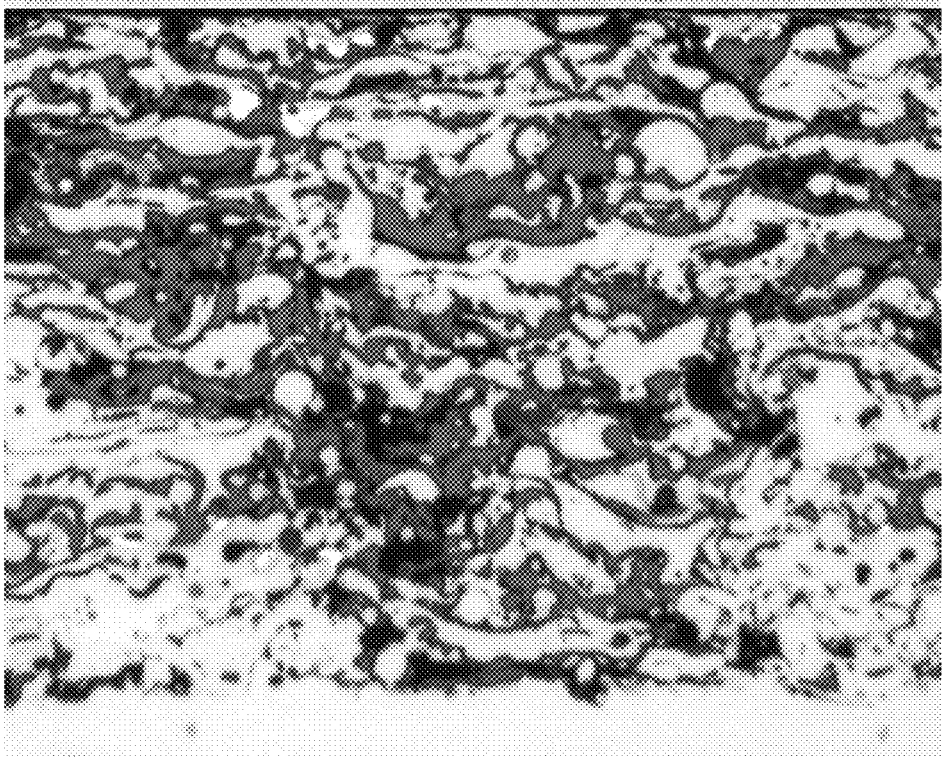
Figure 2 B

HIGH TEMPERATURE SOLID LUBRICANT COATING FOR HIGH TEMPERATURE WEAR APPLICATIONS

ORIGIN OF THE INVENTION

The invention described herein was made by employees of the United States Government and may be manufactured and used by or for the Government for Government purposes without the payment of any royalties thereon or therefore.

BACKGROUND OF THE INVENTION

1. Field of the Invention

The invention relates to a composite coating. Specifically, the invention relates to a composite coating capable of use as a lubrication coating at high temperatures.

2. Background of the Disclosure

There is an increasing need for durable lubricant materials that operate over a wide range of temperatures and at high speeds and/or for long durations. Such materials find increasing need in space satellites and vehicles, adiabatic diesel and advanced turbo machinery, process control valve stems, dry running stirling engine cylinders, high speed foil air bearings, rotating face valves, butterfly valve stems, and the like. Numerous advances in the art have been made over the last thirty years since early self-lubricating compositions, such as composites of silver, platinum, molybdenum disulfide, lead oxide and silicon dioxide were disclosed in U.S. Pat. No. 3,199,934. A significant advance was made by Sliney as a porous nickel-chromium alloy in which is dispersed, via infiltration, a metal fluoride eutectic and, optionally, a coating of the eutectic and silver on the outer bearing surface as disclosed in U.S. Pat. No. 3,419,363. However, the porous metal provides a greatly increased surface area and high temperature oxidation of these porous sintered metals posed significant problems at temperatures above about 700 degrees Centigrade. This led to the development of another self-lubricating composite in which the metal component is a porous high temperature alloy body which is either infiltrated with both metal fluorides and glass or via plasma spray co-deposition of the component powders, as disclosed in U.S. Pat. No. 4,214,905. The presence of the glass in the composite increased the oxidation resistance of the metal binder. The silver is electrodeposited on the metal. A still further improvement in the art was the development of a more wear resistant composite of nickel-cobalt bonded chromium carbide with metal fluoride and silver which is known as PS/PM200 and is disclosed in U.S. Pat. No. 4,728,448 and which has been extensively published in the literature. While this material has met with much success as a durable, long lasting, wear resistant self-lubricating composite useful over a wide temperature range, it is expensive and the chromium carbide component is so hard as to require costly diamond grinding to achieve the desired dimensions prior to service. Further, at very high temperatures of 800 degrees Centigrade or more in an oxidative environment such as air, the chromium carbide tends to oxidize. This degrades the friction and wear properties and causes slight dimensional swelling of the composite body. It would be a significant improvement to the art if a material were available with the strength, low friction and wear characteristics of the PS/PM200, without the drawbacks of very high temperature oxidative instability, high component cost and the need for expensive diamond grinding to polish the bearing surfaces and achieve the proper dimensions of the composite body.

Another lubricant was developed by the assignee of the present invention—PS300, containing a nickel chrome matrix with chrome oxide hardeners combined with silver and fluoride solid lubricants. Embodiments of the PS300 lubricant are disclosed in U.S. Pat. No. 5,866,518. While the PS300 coating has proven successful in many applications including foil bearings, opportunities for improvements continue to exist. For example, a thermal expansion mismatch between PS300 and superalloy substrates may cause thermal cycle fatigue spalling in repeated use at temperatures above 500 degrees Centigrade. The PS300 composition was tailored to modify the expansion properties without degrading the coatings tribiological performance. PS304, which is described in the '518 patent, was selected as the preferred coating for deposition on superalloys.

However, several shortcomings of the PS304 were identified through oil-free gas turbine engine testing. For example, coating dimensional stability is an intrinsic weakness of PS304. Early foil bearing and oil-free engine tests conducted at high temperature showed that the coating thickness increased significantly, as much at 7 percent, when the coating is exposed to air temperatures over 500 degrees Centigrade. Coating cohesive strength and hardness also increased. After extensive study, it was determined that chromium oxide phase precipitates were formed inside the matrix phase of the coating resulting in a volume increase or swelling action. The lack of dimensional stability has been overcome by including a high-temperature, extended time (e.g. 150 hours) heat treatment in air prior to final grinding of the coating. While the resulting coating exhibited dimensional stability adequate for many applications, the added heat treatment step added to the manufacturing cost and complexity limiting applications. Further, a significant concern is that long-term oxidation, for example after 10,000 hours, might degrade the coating integrity.

Yet another problem with the PS304, especially for use with foil bearings, is its initially high surface roughness, caused by its porosity, coarse microstructure and morphology, which may result in reduced foil gas bearing load capacity. Following finishing by grinding, PS304 exhibits a typical surface roughness of about 0.8 micrometers root-mean-square ("rms"). This level of roughness is significantly higher than the industry standard for shaft coatings such as thin dense chrome that typically has a smoother finish on the order of 0.2 micrometers rms. This phenomenon diminishes after the bearings are "broken in" through cyclic sliding cycles at high temperatures but the reduced "as installed" load capacity can preclude the use of PS304 in certain applications. To overcome this shortfall, a research effort identified that burnishing the ground, rough and porous surface with a sacrificial, temporary lubricant, like graphite or molybdenum disulfide, restored bearing load capacity until the breaking in the process occurred.

Therefore, opportunities exist to improve the PS300 series of coatings to overcome known problems and also to develop solutions that may achieve comparable performance but at lower cost and manufacturing complexity.

BRIEF DESCRIPTION OF DRAWINGS

FIG. 2A illustrates a cross-section micrograph of PS304.

FIG. 2B illustrates a cross-section micrograph of the composite coating in an embodiment of the present invention.

SUMMARY OF THE INVENTION

Figure 1:
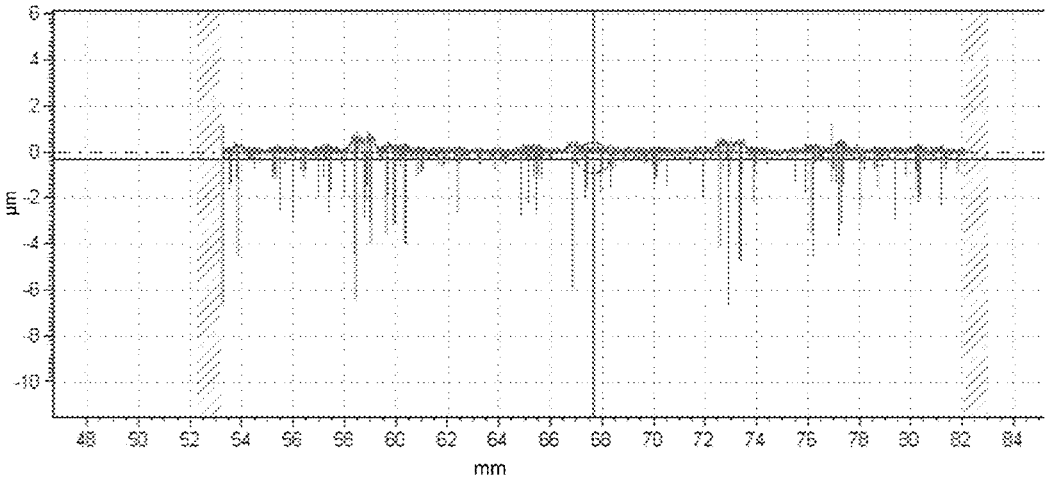
FIG. 1 illustrates a surface roughness profile for a ground composite coating in an embodiment of the present invention.

In an embodiment, the present invention relates to a composite comprising a bonding metal having an alloy containing nickel. The nickel may have a weight percent of greater than 75 weight percent in the bonding metal. The bonding metal comprises more than 50 percent weight of the composite. Metal bonded chromium oxide wherein an amount of the chromium oxide in the composite is less than 40 weight percent of the composite.

In another embodiment, the present invention relates to a composite having metal bonded chromium oxide wherein an amount of the chromium oxide present in the composite ranges from about 5-35 weight percent. The composite may include a bonding metal comprising an alloy containing nickel, wherein an amount of the bonding metal present in the composite ranges from about 50-90 weight percent. In addition, the composite may include a metal fluoride wherein the fluoride comprises a fluoride of at least one metal selected from the group consisting of a Group IA alkali earth metal, rare earth metal, and mixtures thereof, and further wherein an amount of the metal fluoride in the composite ranges from about 1-20 weight percent.

DETAILED DESCRIPTION

Embodiments of a novel composite coating are generally described. While certain embodiments may include specific weight percentages, compositions, or materials, the appended claims should only be limited by the composition coating described therein and interpreted independently of the specific embodiments described herein.

A composite coating, such as a solid lubricant coating, is described herein that has many advantageous uses, including uses as a lubricant in a high temperature environment. More specifically, the composite coating is useful as a durable, self-lubricating, long life, low friction, oxidation and wear resistant material over a broad range of temperatures, from cryogenic temperatures (e.g., about −185 degree Centigrade) up to at least 900 degree Centigrade. For example, the composite coating may advantageously avoid oxidative effects that lead to dimensional swelling.

The composite coating may comprise a metallic based binder. Unlike the prior art PS304 coating that uses a metallic chromium binder, the present invention provides an improved binder that may result in improved dimensional stability. The function of the metal binder component is to provide structural strength to the composite over the operating temperature range of interest and under bearing loads which often exceed unit stresses of about 35 $MN/m^2$. The metallic binder may comprise a metal alloy comprising a substantial weight percent of nickel, such as more than 50 weight percent of the metallic binder and preferably more than 75 weight percent. In a preferred embodiment, the metallic binder may comprise about 90 weight percent nickel. Other metallic alloys may be present in the binder, such as aluminum or molybdenum or mixtures thereof. In a preferred embodiment, the metallic binder comprises about 90 weight percent nickel, about 5 weight percent molybdenum, and about 5 weight percent aluminum.

The metallic binder may comprise more than 50 weight percent of the composite coating. As a non-limiting example, the metallic binder may comprise about 50-90 weight percent of the composite. In a preferred embodiment, the metal binder comprises about 70 weight percent of the composite coating. The metallic binder may be applied from a plasma spray feedstock.

To strengthen the composite coating, a hardening agent may be added to the composite coating. The hardening agent may comprise a metal bonded oxide, such as chromium oxide. In an embodiment, the metal bonded oxide is preferably chromic oxide ($Cr_2O_3$) in which the chromium is trivalent. The metal bonded oxide provides hardness, wear resistance, thermal stability and exhibits a low coefficient of friction when used in sliding contacts. Chromium oxide, for example, is more oxidatively stable than other well known hard and wear resistant materials such as tungsten carbide, titanium carbide, titanium nitride and chromium carbide. It is also less expensive than chromium carbide and, unlike a self-lubricating composite employing chromium carbide that must be diamond ground, the composite of the invention employing the chromium oxide is readily ground using a substantially less expensive abrasive such as silicon carbide. Other advantages of using chromium oxide instead of chromium carbide are that the chromium oxide acts as a high temperature lubricant leading to reduced high temperature counterface wear. In contrast, the prior art chromium carbide utilized as the wear resistant component is abrasive to counterface materials, even at high temperatures. The particles are dispersed throughout the metal binder. The particle size of the chromium oxide useful in the practice of the invention will broadly range from about 20-200 microns, with a particle size range of from about 40-120 microns preferred for plasma spray deposition applications. The weight percent of the metal oxide in the composite may range from about 5 weight percent to about 40 weight percent of the composite coating, and preferably less than 40 weight percent of the composite coating. In a preferred embodiment, the metal bonded oxide comprises about 20 weight percent of the composite coating.

High and low temperature solid lubricants may be added to the composite coating. For example, one or more metal fluorides may be added. It will be appreciated that numerous metal fluorides salts may be employed to achieve the desired high temperature lubrication features of the invention. Illustrative of such fluoride salts are the alkali and alkaline earth metal salts of Group IA and Group IIA metals of the Periodic Table of the elements, as well as fluorides of one or more of the rare earth elements (Lanthanide series), with eutectic fluoride mixtures of two or more such metals or elements being preferred. Particularly preferred are fluorides of barium and calcium, with the eutectic composition of barium and calcium fluoride being most preferred. The metal fluoride may comprise about 1-20 weight percent of the composition, or more preferably less than 10 weight percent of the composition coating. In a preferred embodiment, the metal fluoride may comprise about 5 weight percent of the composition coating.

The optional, but preferred low temperature lubricating metal of the composite coating of the invention will comprise one or more metals, such as one or more noble metals, soft enough to provide lubrication. The lubricating metal may be capable of providing lubrication at low temperatures, including cryogenic temperatures, yet exhibiting oxidation resistance along with a high enough melting temperature to enable it to be used over a broad temperature range. For example, the lubricating metal may comprise at least one metal selected from the group consisting essentially of Ag, Au, Pt, Pd, Rh, Cu and mixtures thereof, with one or more of Ag, Au, Pt, Pd and Rh preferred, due to their high temperature oxidation resistance. The maximum service temperature with copper or a high copper alloy is about 600 degree Centigrade. The maximum service temperature with a high content of a high melting noble metal such as Platinum is about 900 degrees Centigrade. A high silver content alloy also has a maximum service temperature of about 900 degrees Centigrade. As stated above, while the presence of a metal or metal alloy which imparts low temperature lubrication to the composite is optional, for most purposes its presence is preferred. While the amount of these metals or alloys will range from about 0.1-20 weight percent and preferably 5-20 weight percent as set forth above, it will be appreciated that the time-temperature profile and the use environment for the bearing material will predicate the amounts of these components, particularly the relatively low melting silver and the less oxidative and chemically resistant silver and copper. Accordingly, bearing surfaces which are put into prolonged high temperature service, i.e., more than about 90% of their operating time at temperatures in excess of about 500 degrees Centigrade, and especially if the use environment is oxidative, may incorporate significant amounts (50% or more) of higher melting and more oxidative resistant noble metals other than the less oxidative resistant copper, in the alloy. Thus, the preferred 0.1-10 weight percent low temperature alloy component of the composite under such conditions will comprise 50 weight percent or more of Ag, Au, Pt, Pd, Rh and mixture thereof, under high temperature, oxidative service conditions. The preferred embodiment of the composite coating includes less than 10 weight percent silver, and preferably about 5 weight percent silver.

The coating of the present invention differs from the prior art PS304 in more than the binder alloy. As one example, the solid lubricant of the composite coating of the present invention in at least one embodiment is about half of the solid lubricant content of PS304. As a result, the composite coating has an improved high temperature strength than PS304. In addition, the composite coating has an improved achievable surface finish through reduced residual porosity and refined microstructure.

A composite coating of the invention may be prepared by a number of methods. For example, various techniques may be used to prepare a composite coating of the invention, including infiltration and hot isostatic pressing. In a preferred embodiment, the composite coating is applied by plasma spraying the composite onto a suitable substrate and then grinding and polishing the resulting coating or deposit with an abrasive.

A non-limiting example of a plasma spray coating technique for applying the composite coating is described herein. As previously stated, other application techniques are possible, and the present example should not be deemed as limiting the invention to plasma spray application. The composite coating may be applied by any method or technique known to a person having ordinary skill in the art. Powders of the individual components mentioned above are weighed and mixed in a suitable container. The powders in the container may be mixed by hand or other method and then poured into another container, such as a rotary drum of a commercial plasma spray powder feeder. In the spray powder feeder, rotating motion of the drum continuously mixes the powder blend before and during a spray deposition process. To deposit the composite coating, the powders are injected into a gas carrier stream, such as an argon gas carrier stream, and fed into a plasma spray gun. Inside the gun, a source, such as an electric field, ionizes inert gas to provide the high temperatures (e.g. more than 10,000 K) to melt the particles. The molten particle-inert gas stream is projected onto the substrate where they form splats that solidify and adhere to form a coating. Many passes are made to build up a thick, dense coating, for example, approximately 300 micrometers thick. Table I identifies example parameters that may be employed with a plasma spray.

TABLE I

Example Plasma Spray Parameters

| Parameter | Value |
|---|---|
| Current | 600 A |
| Voltage | 30 to 32 V |
| Standoff distance | 8 to 10 cm |
| Argon arc gas flow rate | ~35 SLPM |
| Powder flow rate | ~1 kg/hr |
| Powder gas flow rate | 0.4 $m^3$/hr |

In the example application using a plasma spray process, a rough surface may result that may be ground smooth to the desired coating thickness and dimensions. It is typically acceptable to have a coating thickness range from about 200 to 400 micrometers. Thicker coatings can be made but may suffer from poor strength and residual stresses. Coatings thinner than 125 micrometers may lack adequate bond strength. The present invention should not be limited to any thickness or dimension of the coating.

Grinding using, for example, silicon carbide or diamond abrasive wheels, may be performed on the surface having the coating. In an embodiment, using standard grinding practices, surface rms finishes of about 0.25 micrometers may be preferred. A stylus surface profilometry trace of the coating is shown in FIG. 1. This surface finish represents an improvement over PS304 that generally exhibits a ground surface roughness two to three times rougher (e.g. 0.5 to 1.0 micrometers rms). The rough surface of PS304 is attributed to residual porosity and preferential removal of soft lubricant phases namely the fluorides, present at the surface. In coating form, the present invention appears to have very low porosity and a finer microstructure. The reduced soft-phase content, compared to PS304, may also be contributing to the smoother final finish. In any case, the smooth finish of the composite coating is an advantage for its use in gas foil bearings. FIG. 2A illustrates a cross-section micrograph of the PS304, and FIG. 2B illustrates a cross-section micrograph of an embodiment of the coating of the present invention.

Advantages and benefits of the composite coating of the present invention are illustrated by the examples described hereto. None of the examples should be deemed as limiting the present invention and are merely used as examples to illustrate the advantages and uses of the composite coating of the present invention. For simplicity purposes, the composite coating of the present invention is designated as PS400.

Figure 3:
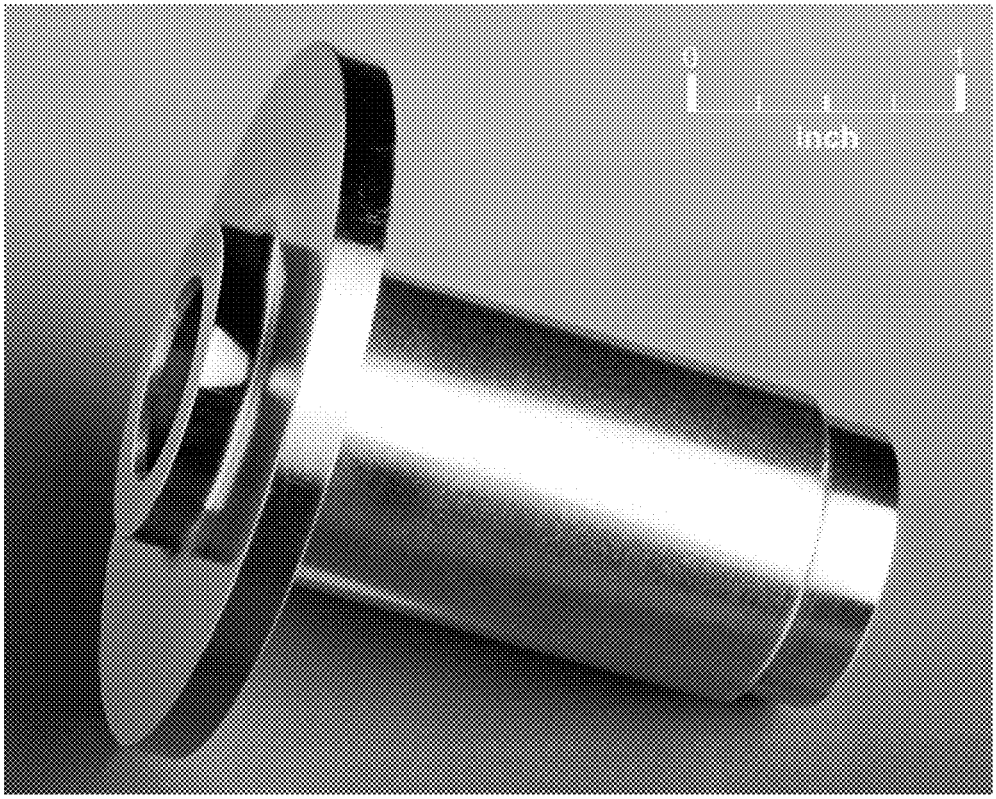
FIG. 3 illustrates a turbine engine shaft coated with a composite coating in an embodiment of the present invention.

Three types of composite coating specimens are fabricated for illustration of the advantages of the coating herein. The three coatings are made from a precipitation-hardened nickel-based superalloy, Inconel X-750. For measuring coating strength and making metallographic cross-section samples, cylindrical coupons that are 25 millimeters in diameter and 6 millimeters thick are coated on one face with PS400. For evaluating the basic friction and wear properties, disk specimens, 63 millimeters in diameter and 12.5 millimeters thick are coated on one face with PS400, which is then ground to a smooth surface and a final coating thickness of about 250 micrometers. Finally, oil-free turbine engine shafts are fabricated and coated on the hot journal bearing location with PS400. Like the disk specimens, the engine shaft coatings are ground to a smooth finish and a final thickness of 250 micrometers. FIG. 3 shows a turbine engine shaft coated with PS400.

Two counter-face specimen geometries are used in sliding contact operating against the coating, pins and foil bearings. For the pin-on-disk testing, hemispherical tipped pins are made from the common nickel base superalloy Inconel X-750. For the foil bearing evaluations, Inconel X-750 foil sheet is formed into a curved shape that is wrapped around the engine shaft coated in PS400. Details about the foil bearing geometry and fabrication can be found in the literature, such as U.S. Pat. No. 5,427,455 which is incorporated herein, and Lubell, et al.: "Test Evolution and Oil-Free Engine Experience of a High Temperature Foil Air Bearing Coating," Proceedings of GT2006:ASME Turbo Expo 2006, May 8-11, 2006, Barcelona, Spain, Paper Number GT2006-90572 (hereinafter "Lubell").

The specimens of PS400 were evaluated using the following tests: (1) coupon level coatings heat treated and tested for adhesion and then cross-sectioned for coating microstructure analyses; (2) bench type friction evaluations using a standard pin-on-coated disk test; and (3) foil bearing evaluation in a hot bearing location within a microturbine engine.

The coating strength and adhesion tests were carried out using a commercially available adhesion tester (See DellaCorte, Christopher: "The Effects of Substrate Material and Thermal Processing Atmosphere on the Strength of PS304: A High Temperature Solid Lubricant Coating," Tribological Transactions, Vol. 46, No. 3, pp. 361-368, 2003.). In the adhesion tester, an aluminum stud is glued to the coating surface with a catalyzed epoxy adhesive. The stud is then pulled form the coating using an instrumented pneumatic cylinder that records the pull off pressure from which the force is calculated. If the coating separates from the substrate, the pull-off force reflects the adhesion strength. For plasma sprayed coatings, the substrate-coating bond often exceeds the cohesive strength of the coating itself or the bond between the epoxy and the coating. In these cases, the strength results thus reflect the coating strength under tensile loads or the glue bond strength, respectively.

In first test, coated coupons were heat treated in air and vacuum at 760° C. for 15 hours then evaluated via pull-testing to see the effects, if any, thermal exposure may have on coating strength. In previous studies with PS304, thermal exposure to air for varying times and temperature resulted in a significant increase in coating strength. For evaluating possible effects of thermal exposure on the microstructure of the coating, coated coupons were exposed to air, argon or vacuum at 760° C. for 24 hours, and then cross-sectioned and polished using conventional metallographic techniques. These cross-sections were examined using optical microscopy.

In the second test, a pin-on-disk rig was used to slide coated disks against the superalloy pins in room air at 25,500 and 650° C. The load was 0.5 kG (4.9N) and the sliding speed was 3 meters per second with a wear track diameter of 50 millimeters. The tests were generally run for about 90 minutes at each temperature in three equal 30-minute segments beginning with the highest test temperature with subsequent tests working down to room temperature. Three repeat sequences were run using a new pin and disk specimen set to assess data scatter. Selected experiments were run longer to evaluate test duration effect on steady-state friction. Friction was measured continuously using a chart recorder. Wear was measured after each 30 minute test using optical microscopy measurements of the pin wear scar diameter and stylus surface profilometry of the disk wear track. Wear factores (incremental wear volume normalized by the load and incremental sliding distance) were calculated for each segment and averaged to obtain the reported values. The friction and wear data was compared to PS304 to examine the effects of the compositional change on tribological performance.

In the third test, evaluation of the coating in a hot foil bearing was conducted using a Capstone 30 kW, oil-free microturbine engine. In this engine test the cyclic and long-term durability of the coating is characterized by running one engine cycle at full power for 12 hours once per day. This subjects the coating to brief sliding during a cold start and a hot shut down with nearly 12 hours of operation under high centrifugal stresses due to the high shaft speed (96,000 rpm) and high temperature (~500° C.). This test is detailed in Lubell (previously cited herein) and provides coating exposure in a representative engine environment in a convenient, cost effective manner. For characterization, engine start torque is monitored and on occasion the engine is disassembled and the coating is inspected.

Table II shows the coating adhesion results. For comparative purposes, the results for PS304 are listed. The coating pull-off adhesion test results indicate that, for both the PS304 and the coating of the present invention, indicated as PS400, the failure location is within the body of the coating itself, not at the glue-coating or coating-substrate interface. For PS304, the strength as deposited is about 20 MPa. After a heat treatment in air, this value nearly doubles to 34 MPa due to the growth of a second phase oxide precipitate. This hardening effect is accompanied by a volume expansion (thickness increase) of approximately 7 percent and is documented in the literature (See e.g., DellaCorte et al.: "Thermal Processing Effects on the Adhesive Strength of PS304 High temperature Solid Lubricant Coatings," NASA/TM—2001-210944, May 2001).

| Coating | Heat Treatment | | | Pull-off Strength | | Failure |
|---|---|---|---|---|---|---|
| Designation | Temperature (° C.) | Atmosphere | Duration (hr) | Ksi | MPa | Location |
| PS304 | None | N/A | N/A | 2.9 | 20 | Within coating |
| PS304 | 650° C. | Air | 24 | 4.9 | 33 | Within coating |
| PS400 | None | N/A | N/A | 2.9 | 20 | Within coating |
| PS400 | 760° C. | Air | 15 | 3.3 | 23 | Within coating |
| PS400 | 760° C. | Vacuum | 15 | 3.4 | 24 | Within coating |

As indicated above, the coating of the present invention, PS400, exhibits a pull-off strength comparable to PS304 in the as-deposited state, about 20 MPa. This value represents the cohesive strength in tension of PS400 and is fully adequate for the intended coating applications. Following a heat treatment in air, or vacuum, at 760° C. for 15 hours the strength rose moderately to 23 MPa. In addition, PS400 is physically very stable. Close examination of the coating cross-section before and after heat treatment indicates no obvious microstructural or other physical changes to the coating.

Figures 4A, 4B:
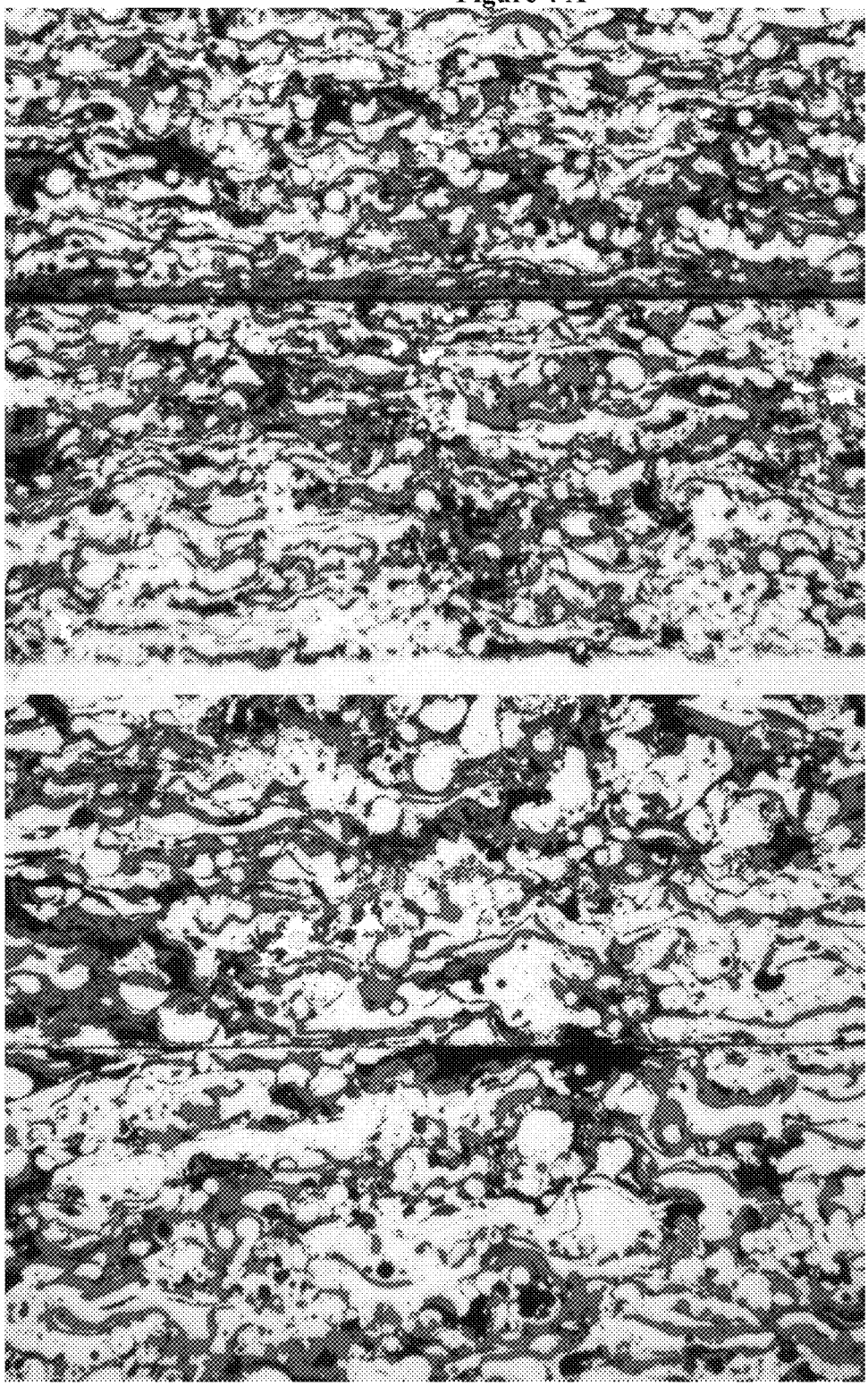
FIG. 4A illustrates a cross-section of a composite coating of the present invention after its top layer has been exposed to air at 760 degrees Centigrade for 15 hours.
FIG. 4B illustrates a cross-section of a composite coating of the present invention after its top layer has been exposed to argon at 760 degrees Centigrade for 15 hours.
Figure 4C:
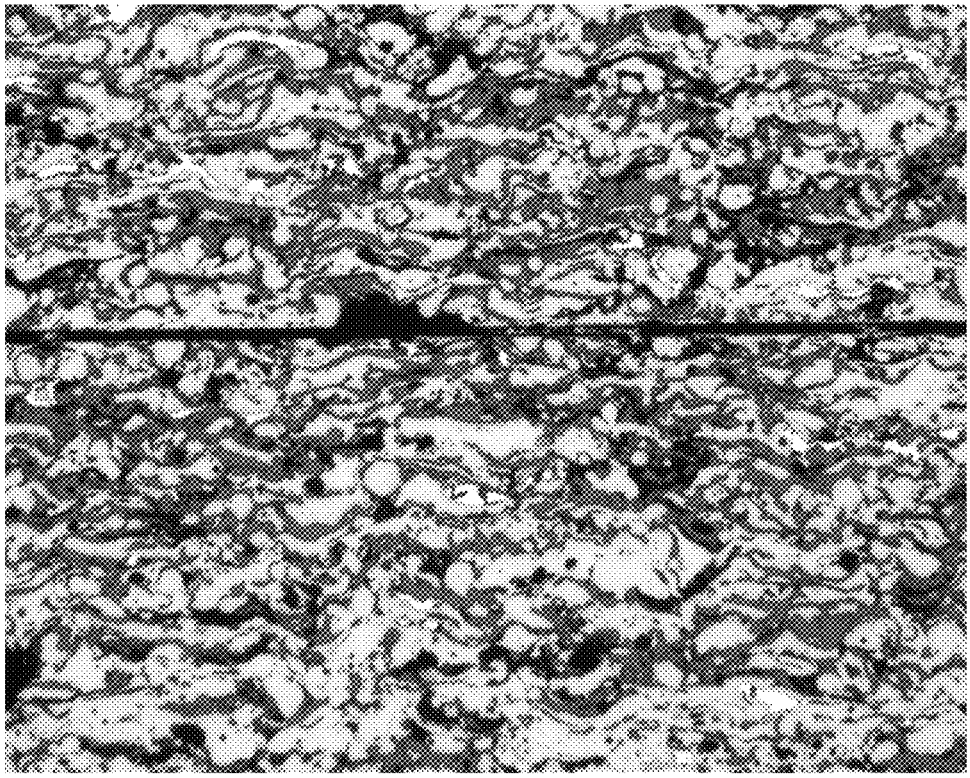
FIG. 4C illustrates a cross-section of a composite coating of the present invention after its top layer has been exposed to vacuum at 760 degrees Centigrade for 15 hours.

FIGS. 4A-4C show photomicrographs of cross-sections of the coating of the present invention with and without heat treatments in air, inert gas and vacuum. FIG. 4A illustrates a cross-sectional of PS400 having its top layer exposed to air at 760° C. for 15 hours. FIG. 4B illustrates a cross-section of PS400 having its top layer exposed to argon at 760° C. for 15 hours. FIG. 4C shows a cross-section of PS400 having its top layer exposed to vacuum at 760° C. for 15 hours. No microstructure or thickness changes are observed for any of the PS400 coatings of the present invention. The modest increase in strength may be related to enhanced bonding between coating phases or possibly the formation of intermetallic phases within the metallic binder phase. Based upon these coupon level tests, it is clear that the coating of the present invention has achieved one important goal, to improve dimensional stability and to obviate the need for post deposition heat treatment.

The pin-on-disk friction and wear data is summarized in Table III. For comparison purposes, the tribological behavior of the original PS304 coating is shown alongside the data for the newly formulated coating of the present invention, PS400. The data trends show that both PS304 and PS400 exhibit markedly lower wear and somewhat lower friction at high temperatures as compared to room temperature measurements. For both coatings, friction is essentially identical at 25 and 650° C. However, advantageously PS400 exhibits far lower friction at 500° C., 0.16 compared to 0.23 for PS304. At high temperatures, the coating of the present invention offers over an order-of magnitude reduction in coating wear and roughly an order of magnitude reduction in counter-face pin wear factor. This is a major improvement in performance. However, the wear factors for both the coating of the present invention and the mating pin at room temperature is two to three times higher than PS304. Clearly, the reduction in solid lubricant content most likely the silver, from the 10 to 5 weight percent, leads to higher room temperature wear for the coating of the present invention.

TABLE III

FRICTION AND WEAR DATA SUMMARY[a]

| Coating Designation | Test Temperature | Friction Coefficient | Pin wear, Kpin $mm^3/N\text{-}m$ | Coating wear, Kdisk $mm^3/N\text{-}m$ |
|---|---|---|---|---|
| PS304 | 25 | $0.31 \pm 0.05$ | $96 \pm 30 \times 10^{-7}$ | $480 \pm 30 \times 10^{-6}$ |
| PS304 | 500 | $0.25 \pm 0.02$ | $32 \pm 5 \times 10^{-7}$ | $280 \pm 30 \times 10^{-6}$ |
| PS304 | 650 | $0.23 \pm 0.02$ | $38 \pm 4 \times 10^{-7}$ | $100 \pm 10 \times 10^{-6}$ |
| PS400[b] | 25 | $0.31 \pm 0.04$ | $141 \pm 28 \times 10^{-7}$ | $1180 \pm 380 \times 10^{-6}$ |
| PS400 | 500 | $0.16 \pm 0.02$ | $2.1 \pm 0.3 \times 10^{-7}$ | $6.3 \pm 1.0 \times 10^{-6}$ |
| PS400 | 650 | $0.21 \pm 0.03$ | $8.9 \pm 2 \times 10^{-7}$ | $7.6 \pm 1.2 \times 10^{-6}$ |

[a]Test load 5N, 3 m/s sliding velocity, air atmosphere 50 percent relative humidity, Inconel X-750 pins.
[b]Test data at 25° C. collected after previous sliding occurred at 650 and 500° C.

During the course of this investigation, an additional pin-on-disk specimen set was run in a reversed temperature sequence; first at 25 then at 500 and lastly at 650° C. The wear data for this test mimicked that shown in Table III but the friction behavior varied significantly. Friction at room temperature increased nearly 40 percent with an observed coefficient of 0.49±0.01. A second room temperature test of this same specimen set after sliding tests at 500 and 650° C. was completed and showed that low friction (~0.30) returned. Thus to achieve low friction with the coating of the present invention, it may be advantageous to utilize a sliding break-in period at elevated temperature. This result may be due to a need to form a lubricious surface glaze in order to achieve a significant friction reduction.

Previous research with PS304 has revealed that different surface layers form on the coating and its mating surface depending on the test temperature (See, DellaCorte, Christopher: "The Evaluation of a Modified Chrome Oxide Based High Temperature Solid Lubricant Coating for Foil Gas Bearings," HASA/TM—1998-208660, October 1998. Tribology Transactions, Vol. 43, no. 2, pp. 257-262, April 2000). These films exhibit unique tribological properties and are generally more capable of mitigating friction and wear than the intrinsic solid lubricants present in the coatings (i.e. silver and fluorides). The surface films, or glazes, form most readily at high temperatures in the presence of sliding contact, and function as effective solid lubricants even when the test temperature is returned to 25° C. Exposing the coating of the present invention to high temperature air may be insufficient to develop the lubricious surface glaze; sliding contact may also be required. Thus it is not surprising to see moderately high friction for PS400 at low temperature until after it has been slid at elevated temperature. For foil gas bearings employing PS304 coatings, sacrificial overlay coatings of graphite were found to be effective. Low friction and wear at elevated temperatures makes the coating of the present invention a good candidate for applications that require improved tribological performance as compared with PS304.

Lastly, the coating of the present invention was extensively tested as a shaft coating operating against a hot section foil bearing in a Capstone Oil-Free 30 kW microturbine engine. After 2200 start-up and shut down cycles conducted over 8000 hr of operation at 96,000 rpm and approximately 540° C., the engine was disassembled and the shaft was inspected. FIG. 3 shows the shaft before testing and FIG. 5 shows the same shaft as it appeared at engine teardown inspection. The shaft coated with a coating of the present invention has visually changed from a metallic silver color to a dark grey with a surface that is polished smooth. This surface is ideal for foil bearings and displays the development of the lubricious surface glazes conducive to good tribological performance. Shaft diameter measurements show no wear on the shaft. Extensive high-temperature foil bearing test experience for PS304 coatings routinely demonstrated over 100,000 start stop rub cycles before measurable wear was observed.

The development of the present coating was undertaken to tailor the coating composition to overcome difficulties in deploying PS304 in high temperature sliding applications. Specifically, the present composite coating exhibits improved coating characteristics over prior art coatings, such as surface finish, dimensional stability and processing costs while retaining positive performance attributes of PS304 such as low friction and wear.

The new composite coating is dimensionally stable regardless of high temperature exposure to air, inert gas or vacuum. The friction and wear properties are comparable to PS304 at room temperature and significantly improved, especially with respect to wear, at elevated temperatures. The achievable surface finish is smoother for PS400 by a factor of three or four and finally, the PS400 requires no post deposition heat treatment to achieve high strength or dimensional stability, thus reducing processing costs.

Overall, based upon the coupon level tests, pin-on-disk bench tests and full foil bearing engine tests, it is clear that the coating of the present invention represents a marked improvement over PS304 and may open new applications in high temperature tribology. A person of ordinary skill in the art will appreciate that the benefits and advantages of the composite coating of the present invention are not limited to those identified in the experiments and others will be apparent and discoverable.

It is understood that various other embodiments and modifications in the practice of the invention will be apparent to, and can be readily made by, those skilled in the art without departing from the scope and spirit of the invention described above. Accordingly, it is not intended that the scope of the claims appended hereto be limited to the exact description set forth above, but rather that the claims be construed as encompassing all of the features of patentability and novelty which reside in the invention, including all the features and embodiments which would be treated as equivalents thereof by those skilled in the art to which the invention pertains.

The invention claimed is:

1. A composite comprising:

a metal fluoride comprising a mixture of barium fluoride-calcium fluoride eutectic and silver and further wherein an amount or the metal fluoride in the composite ranges from about 1-20 weight percent;

a bonding metal which includes a mixture of nickel, aluminum and molybdenum comprising an alloy containing nickel, wherein nickel has a weight percent of greater than 75 weight percent in the bonding metal, and further wherein the bonding metal comprises more than 65 percent weight of the composite;

metal bonded chromium oxide wherein an amount of the chromium oxide present in the composite is less than 35 weight percent of the composite.

2. The composite of claim 1 wherein the metal bonded chromium oxide is a chromium oxide hardener comprising more than 15 weight percent of the composite and less than 35 weight percent of the composite.

3. The composite of claim 2 wherein the metal fluoride is a high temperature metal fluoride lubricant.

4. The composite of claim 1 further comprising a low temperature soft metal lubricant wherein an amount of the soft metal present in the composite ranges from 1-20 weight percent of the composite.

5. A composite comprising:

metal bonded chromium oxide wherein an amount of the chromium oxide present in the composite ranges from about 5-30 weight percent;

a bonding metal comprising an alloy containing nickel and at least one of aluminum or molybdenum or mixtures thereof, wherein an amount of the bonding metal present in the composite ranges from about 70-90 weight percent;

a metal fluoride wherein said fluoride comprises a fluoride of at least one metal selected from the group consisting of a Group IA alkali earth metal, rare earth metal, and mixtures thereof, and further wherein an amount of the metal fluoride in the composite ranges from about 1-20 weight percent; and further comprising 1-15 weight percent of one or more low temperature lubricating metals selected from the group consisting of silver, gold, platinum, palladium, rhodium, and copper.

6. The composite of claim 5 wherein the metal bonded chromium oxide comprises about 20 weight percent.

7. The composite of claim 6 wherein the metal fluoride comprises about 5 weight percent.

8. The composite of claim 5 wherein the bonding metal is a mixture of nickel, aluminum and molybdenum and further wherein the bonding metal comprises at least 80 weight percent nickel.

9. The composite of claim 5 wherein the bonding metal comprises about 90 percent weight nickel, about 5 percent weight aluminum and about 5 weight percent molybdenum.

10. The composite of claim 9 wherein the metal fluoride comprises a mixture of barium fluoride-calcium fluoride eutectic and silver.

11. The composite of claim 5 wherein the metal bonded chromium oxide is a chromium oxide hardener.

12. The composite of claim 11 wherein the metal fluoride is a high temperature metal fluoride lubricant.

* * * * *